United States Patent [19]

Mason

[11] Patent Number: 4,989,482

[45] Date of Patent: Feb. 5, 1991

[54] METHOD AND APPARATUS FOR PUNCHING A HOLE IN SHEET MATERIAL

[75] Inventor: Murray R. Mason, Woodstock, Canada

[73] Assignee: TI Corporate Services Limited, London, England

[21] Appl. No.: 437,587

[22] Filed: Nov. 17, 1989

[51] Int. Cl.[5] ..... B21D 28/28; B26F 1/14

[52] U.S. Cl. ..... 83/22; 83/24; 83/54; 83/98; 83/686

[58] Field of Search ..... 83/22, 24, 53, 54, 98, 83/100, 103, 684, 686, 86, 97

[56] References Cited

U.S. PATENT DOCUMENTS

| | | | |
|---|---|---|---|
| 1,887,360 | 11/1932 | Olsen | 83/684 X |
| 2,187,651 | 1/1940 | Jackson | 83/86 |
| 2,258,070 | 10/1941 | Sawle | 83/97 |
| 2,994,923 | 8/1961 | Eddy . | |
| 3,382,690 | 5/1968 | Aschler et al. . | |
| 3,487,668 | 1/1970 | Fuchs, Jr. . | |
| 3,495,486 | 2/1970 | Fuchs, Jr. . | |
| 3,730,035 | 5/1973 | Bhatia . | |
| 3,781,124 | 12/1973 | Bodycomb | 83/98 X |
| 4,314,468 | 2/1982 | Baril et al. . | |

*Primary Examiner*—Hien H. Phan
*Assistant Examiner*—Eugenia A. Jones
*Attorney, Agent, or Firm*—Ridout & Maybee

[57] ABSTRACT

A method of and apparatus for punching a hole in sheet material is provided using pressurized fluid as the female die together with a modified male punch. The slug of material to be sheared from the material is during and after shearing continuously held against the face of the punch by the difference in pressure between the fluid and the punch face. In addition the area adjacent the perimeter of the hole may be deformed and drawn away from the die block face as the punch advances through the material. As the punch is withdrawn, the slug remains held against the punch face. The mechanical force withdrawing the punch together with the fluid pressure bearing on the slug and deformed area forces the slug and deformed area of material toward the die block face, inelastically retracting the deformed area. The deformed area may be fully retracted to a substantially flat form or partially retracted to a countersunk form.

12 Claims, 4 Drawing Sheets

METHOD AND APPARATUS FOR PUNCHING A HOLE IN SHEET MATERIAL

The invention is directed to a method and apparatus for punching a hole in sheet material using pressurized fluid to perform the function of a female die.

In conventional hole punching, of a circular hole for example, sheet material is positioned between the faces of an annular female die and a cylindrical male punch. The outer diameter of the male punch is marginally less than the inner diameter of the female die. The difference in diameters generally increases with the thickness of the material. As the male punch face advances to engage a forward surface of the material, a rearward surface of the material, opposite the forward surface, engages the face of the female die. Upon further advancing of the male punch through the sheet material, a slug is sheared under the coupled shearing forces applied to the material by the cutting edges of the punch and die faces. After continued use the cutting edges of the punch and die faces may become chipped or unevenly worn. Initially such wear does not significantly affect the quality of the operation since the shearing forces are approximately evenly distributed around the perimeter of the cutting edges. Such even force distribution results from the positive contact between the cutting edges and the material, and from the plastic flow of the material which compensates for minor irregularities in the cutting edges.

Eventually the wearing of the cutting edges progresses to such a degree that the quality of the operation becomes unacceptable due to sheared edge irregularities and a significant increase in the force required to shear the slug from the material. Punches and female dies are generally constructed as replaceable inserts housed within the mating die block faces to facilitate rapid replacement when the cutting edges become excessively worn.

In certain circumstances it is impractical or impossible to position a female die adjacent the rearward surface of the material to carry out hole punching as described above, as for example in the punching of holes in the walls of tubes, molded vessels, extruded profile members and items of complex geometry having inaccessible areas. Although holes in such items often may be drilled, punching is preferred since punching is generally less costly and requires a lesser degree of mechanical complexity. In such circumstances the function of the female die may be carried out by a pressurized fluid in contact with the rearward surface of the material as described in U.S. Pat. No. 3,487,668 to Fuchs, Jr. The use of a pressurized fluid to perform the function of the female die is especially advantageous where the punching of holes is carried out in conjunction with the forming of tubes or vessels under the force of internal fluid pressure within a forming die block. Punches are easily housed within the forming die block. As the fluid pressure forces the material to conform to the contours of the forming die block face, the forward surface of the material is ultimately positioned adjacent the die block face. As the punch is advanced to engage the forward surface of the material, the rearward surface is supported by the pressurized fluid. Upon further advancement of the punch through the material to shear a slug, the pressurized fluid continues to bear upon the material to be removed as a slug and the adjacent material. The slug is sheared under the mechanical force applied to the material by the cutting edge of the punch and the force applied to the material adjacent the slug by the pressurized fluid.

It will be understood by those skilled in the art that the conventional method described above and in U.S. Pat. No. 3,487,668 to Fuchs, Jr. although particularly advantageous in relation to punching of holes in closed items such as tubes or vessels, is also applicable to punching of holes in any item constructed of sheet material such as plates, or extruded profile members if suitable means are used to contain the pressurized fluid in contact with the rearward face of the material.

The conventional apparatus and methods described above, which utilize a pressurized fluid in punching holes, suffer from the significant disadvantage that the slug tends to remain attached to the material in a hinge-like manner at a point on its circumference. The retention of the slug requires further steps in manufacturing to remove the slug and interferes with the utilization of a tube or vessel if not removed. Through repeated use the cutting edge of the punch becomes chipped or worn. Even when such punch wear is of a degree which would be insignificant in use with a female die, such wear increases the tendency to retain the slug in a hinge-like manner, requiring more frequent punch replacement and resulting in increased downtime.

During conventional methods of punching a hole utilizing pressurized fluid, as the punch advances to remove a slug, a deformed area of sheet material adjacent the perimeter of the hole is formed as the deformed area is inelastically drawn away from the die block face. As a result an often undesirable countersunk or depressed deformed area is formed. When relatively small holes are punched in thin material the deformed area may be acceptable since it aids in guiding fasteners through the hole. However, when larger holes or thicker material is punched, the dimensions of the deformed area resulting may be such as to render the punching method impractical or uneconomic if further manufacturing steps are required to lessen the deformation to acceptable levels. In such a case therefore drilling of holes may be preferred since although generally drilling is more costly than punching, such reworking of the deformed area consumes or exceeds any cost savings resulting from use of the conventional punching method described above.

The present invention relates to a novel method and apparatus, for punching holes using pressurized fluid to perform the function of a female die, which addresses the disadvantages of conventional methods and apparatus as described above.

In accordance with the present invention is provided a method of punching a hole in sheet material comprising: positioning a forward surface of said sheet material adjacent a die block face; exposing a rearward surface of said sheet material, opposite said forward surface, to pressurized fluid; advancing a punch housed within the die block, to engage said forward surface, the space between said forward surface and the face of said punch maintained at a pressure less than the pressure of said fluid; further advancing said punch through said sheet material to shear a slug from said material, said slug during and after shearing being continuously held against the face of said punch by the difference in pressure between said fluid and said space adjacent said punch face.

Further in accordance with the present invention is provided an apparatus for punching a hole in sheet material comprising: a die block having a die block face which mates with a forward surface of said sheet material; means to expose a rearward surface of said sheet material, opposite said forward surface, to pressurized fluid; a punch housed within said die block, said punch having a first bore communicating between the punch face and means to maintain pressure less than the pressure of said fluid; and means to advance and retract said punch relative to said die block face to punch a hole in said sheet material.

In order that the invention may be readily understood, a preferred embodiment of the invention is described below with reference to the accompanying drawings in which.

Figure 1:
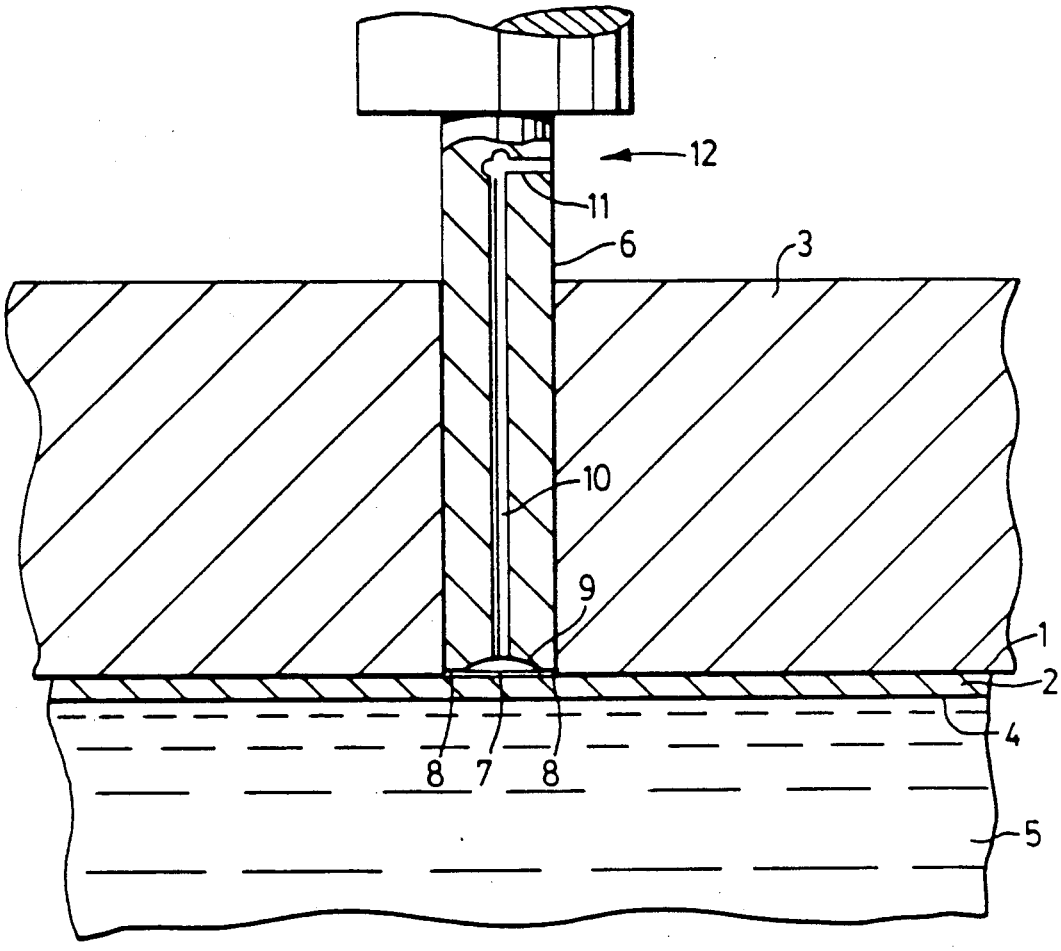
FIG. 1 is a sectional view through the punch axis, showing the die block, sheet material and pressurized fluid, prior to commencing the punching operation.

Referring to FIG. 1 a forward face 1 of the sheet material 2 is positioned adjacent the face of a die block 3. As described in relation to conventional methods above, the die block 3 may be a contoured forming die block although the example die block 3 illustrated is linear in the plane of the drawings. A rearward surface 4 of the sheet material 2 is exposed to a pressurized fluid 5, such as water or air for example.

A punch 6 is housed within the die block 3 such that the punch 6 slides in a direction perpendicular to the forward face 1 of the sheet material 2. Means to advance and retract the punch 6 relative to the die block 3 face are conventional and are not illustrated in the drawings.

Means to expose the rearward surface 4 to pressurized fluid 5 when the sheet material 2 is the wall of a tube or vessel comprise plugs inserted in the tube or vessel openings, at least one of which plugs having a pressurized fluid inlet. In other applications the means to expose the rearward surface 4 to pressurized fluid 5 may comprise means to enclose and seal the zone adjacent the proposed hole location and a pressurized fluid inlet. It will be apparent to those skilled in the art that air or any other gas or any fluid may be pressurized and used in conjunction with the invention. However liquid is preferred over gases in such an application due to the practical difficulties in compressing large volumes of gases to the pressures required. Liquids such as water are incompressible and therefore the volume of liquid to be handled during operation is significantly less than the volume of gas required to achieve the same result. Air or other gases are generally evacuated from within the chamber to be filled with liquid either through the liquid inlet or through a separate outlet. The pressure of the fluid varies considerably depending upon the material thickness and structural properties, as well as the punch dimensions. The pressure differences between the fluid 5 and the space between the punch face 7 and the forward surface 1 may be in the range of 100 to 10,000 pounds per square inch and is preferably in the range of 4000 to 6,000 psi, when sheet metal material is punched.

Means are provided to maintain the pressure of the space between the forward surface 1 of the material 2 and the punch face 7 at a pressure less than the pressure of the fluid 5. In the particular embodiment illustrated in the drawings the punch 6 has a first bore 10 communicating between the punch face 7 and means to maintain the pressure less than the pressure of the fluid 5. The means to maintain pressure illustrated comprise a second bore 11 communicating between the first bore 10 and a zone of ambient atmospheric pressure 12. In alternate embodiments of the invention the means to maintain pressure may comprise pressure regulators to maintain a vacuum, or a pressure higher than atmospheric in order to enable selection of a specific difference in pressure between the fluid 5 and the punch face 7.

The punch face 7 in the particular embodiment illustrated, comprises a perimeter cutting edge 8 and a concave central portion 9, the advantages of which will become apparent in the description below.

Figure 2:
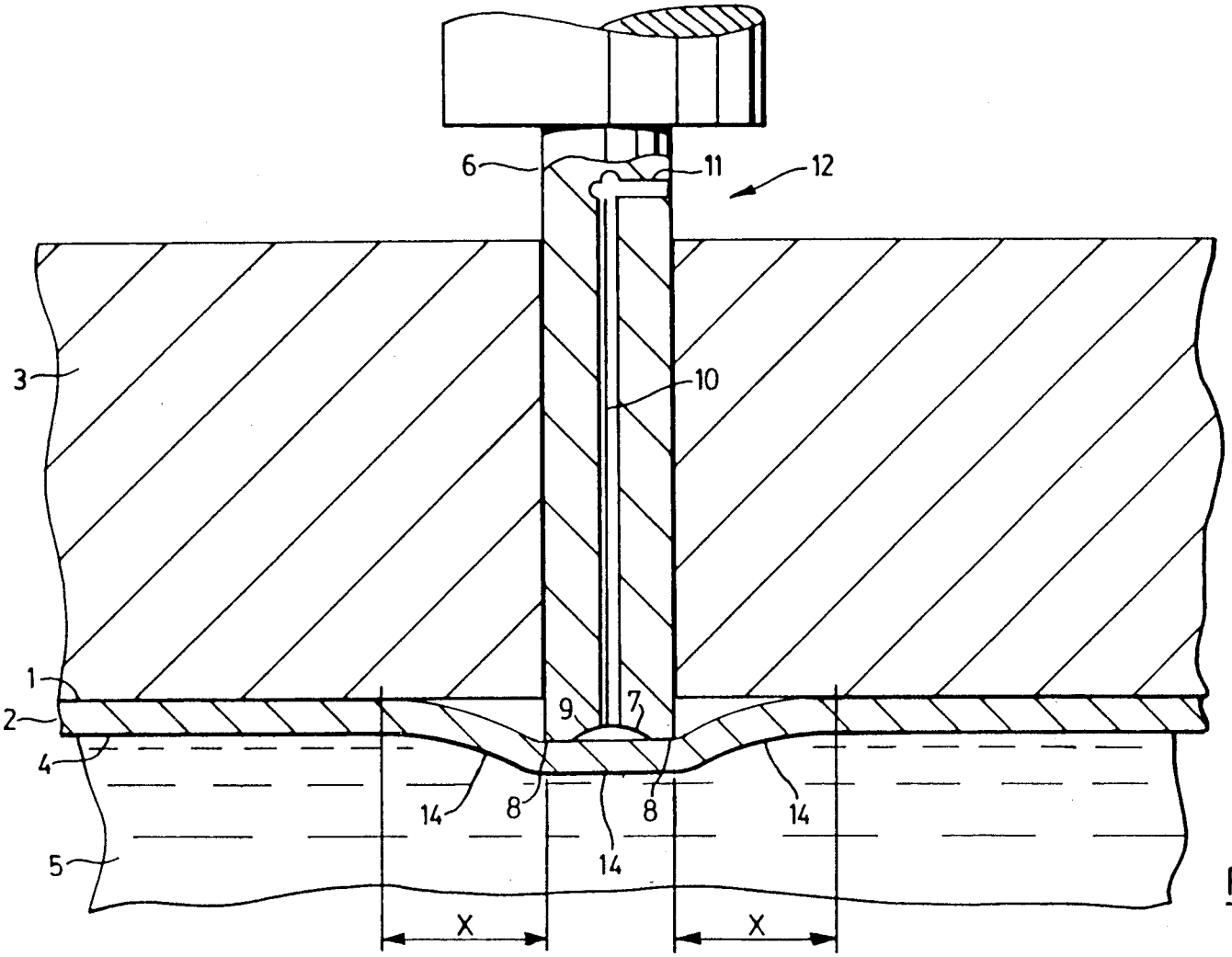
FIG. 2 is a sectional view showing the punching operation immediately prior to shear stress failure of the material.

Referring to FIGS. 1 and 2, in order to punch a hole in the sheet material 2, the punch 6 is advanced to engage the forward surface 1 of the material 2 with the punch's cutting edge 8. The space between the forward surface 1 and the punch face 7 is maintained at a pressure less than the pressure of the fluid 5. In the embodiment illustrated the pressure of such space is maintained at atmospheric pressure as a result of the venting means comprising a first and a second bore 10 and 11 which communicate between the punch face 7 and a zone of ambient atmospheric pressure 12. The concave central portion 9 of the punch face 7, by aiding in air distribution, ensures that a substantial central area of the space adjacent the punch face 7 is maintained at atmospheric pressure during the punching operation since the material 2, to be removed as a slug, may deform into the concave central portion 9 of the punch face 7 as shown in FIG. 2.

Figure 3:
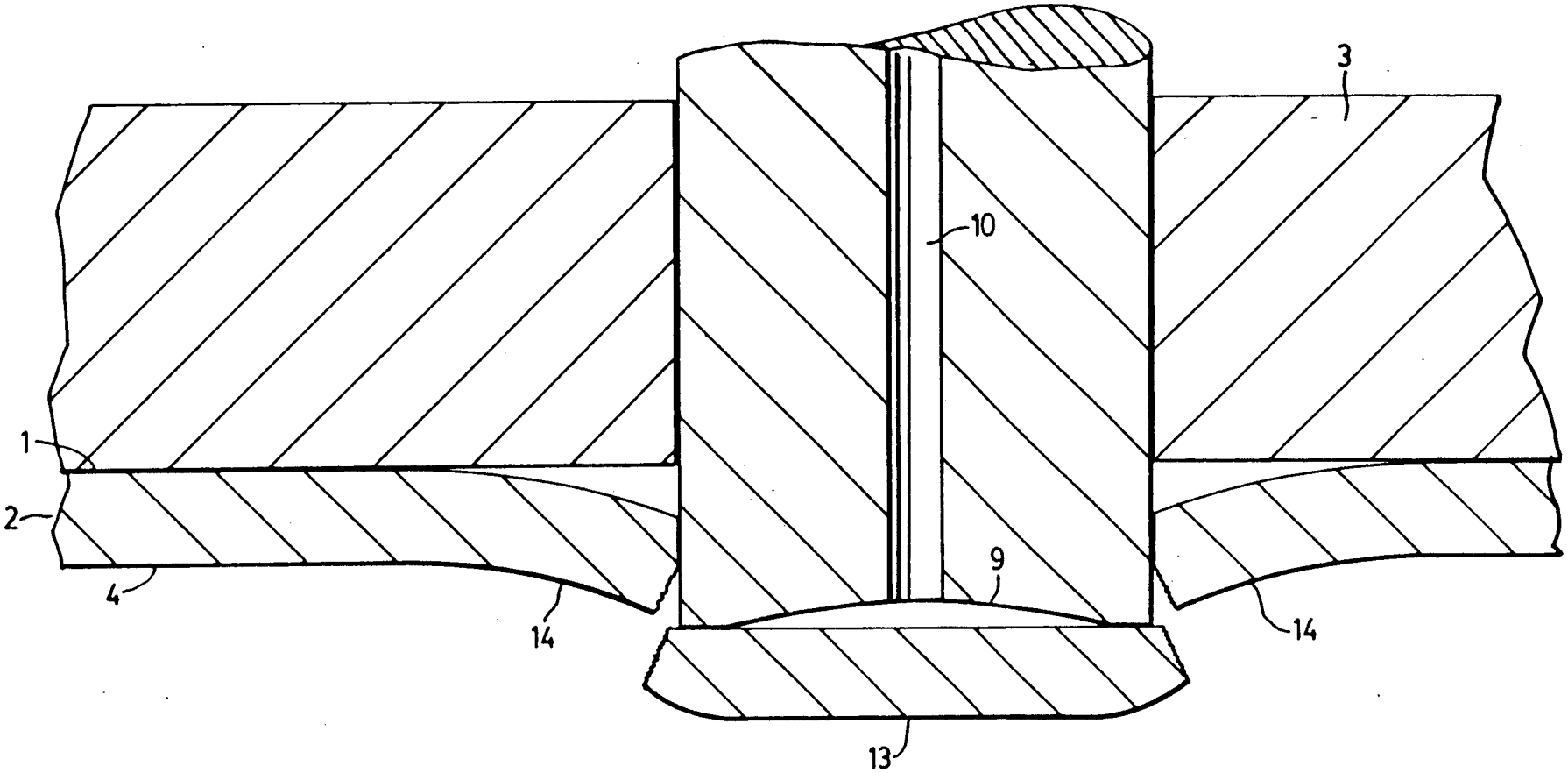
FIG. 3 is a sectional view showing the removed slug and deformed area after the punching operation.

Referring to FIGS. 2 and 3, as the punch 6 is further advanced through the sheet material 2 to shear a slug 13 from the material 2, the slug 13 during and after shearing is continuously held against the punch face 7 by the difference in pressure between the fluid 5 and the space adjacent the punch face 7. The slug 13 therefore remains in contact with substantially the entire perimeter of the cutting edge 8 of the punch 6 resulting in a uniform distributed shearing force about the perimeter of the cutting edge 8. The pressurized fluid 5 uniformly bears upon the rearward face 4 of the material 2 adjacent the material to be removed as a slug 13. As a result of these opposite substantially uniform forces, the shear stress induced in the material 2 adjacent the cutting edge 8 is substantially uniform and the slug 13 does not tend to remain attached to the material 2 in a hinge-like manner at a point on its circumference but is clearly sheared from the material as illustrated in FIG. 2. Even when the cutting edge 8 initially becomes worn or chipped to a limited degree, the slug 13 is clearly sheared since the slug 13 is firmly held against the punch face 7 enabling the plastic flow of the material 2 to compensate for such minor irregularities in the cutting edge 8.

FIG. 2 illustrates the punching operation immediately prior to shear stress failure, where the shear stress induced in the material 2 exceeds the material's shear strength adjacent the cutting edge 8. As the punch 6 advances, a deformed area 14 of sheet material 2 adjacent the perimeter of the hole is formed, as the deformed area 14 is drawn away from the face of the die block 3. The total amount of deformation of the deformed area 14 shown in FIG. 2, is part inelastic or plastic deformation, and part elastic or resilient deformation.

Referring to FIG. 2 the rearward surface 4 of the material 2 is exposed to pressurized fluid 5. The material 2 not adjacent the punch 6 is supported upon its forward surface 1 by the die block 3. The central portion of the deformed area 14 is supported by the punch face 7, which comprises the cutting edge 8 and the concave central portion 9. The outer portion 'x' of the deformed area 14 is unsupported and therefore the pressure of the fluid 5 bearing upon area of the outer portion x provides the shearing force required to shear the slug 13 from the material 2.

Using the example of the punching of a circular hole, mathematically expressed, the approximate interrelation between the parameters involved in such a punching operation upon shear stress failure, as illustrated in FIG. 2, is as follows:

where $F_p$ is the shearing force applied by the punch 6;
$F_d$ is the force applied by the liquid 5 upon the deformed area 14;
T is the thickness of the material 2;
S is the shear strength of the material 2;
$D_p$ is the diameter of the punch 6;
$D_d$ is the diameter of the deformed area 14; and
P is the pressure of the fluid 5, and assuming that the effect of material strength on deformation is for practical purposes insignificant at the high pressures required such effect is omitted for the purposes of this description.

At failure therefore: $F_p = F_d$ $$F_d = P\pi D_d^2/4$$

$$F_p = \pi D_p T S + P\pi D_p^2/4$$

Solving for $D_d$ therefore:

$$D_d = \sqrt{4\ D_p\ T\ S/P + D_d^2}$$

since $D_d = 2x + D_p$ then $x = D_p(\sqrt{T\ S/P\ D_p + 0.25} - 0.5)$

As pressure P increases, and as the resistance of the material 2 decreases (i.e. thickness T or shear strength S decreases) the outer portion x of the deformed area 14 decreases. By varying the relative values of pressure P to the material resistance (T and S), it is therefore possible to control the degree of deformation.

Referring to FIG. 3 the deformed area 14 and removed slug 13 are shown after shear failure during the punching operation. The deformed area 14 at the stage illustrated in FIG. 3 is smaller than the deformed area 14 immediately prior to shear failure as illustrated in FIG. 2 since the pressure of the fluid 5 continues to bear upon the outer portion x of the deformed area 14 after shearing, forcing the outer portion x towards the die block 3.

As explained above in relation to conventional methods, a relatively small degree of deformation after punching may be acceptable but often when relatively large holes or resistant material is punched, the larger dimensions of the deformed area 14 may be unacceptable.

Figure 4:
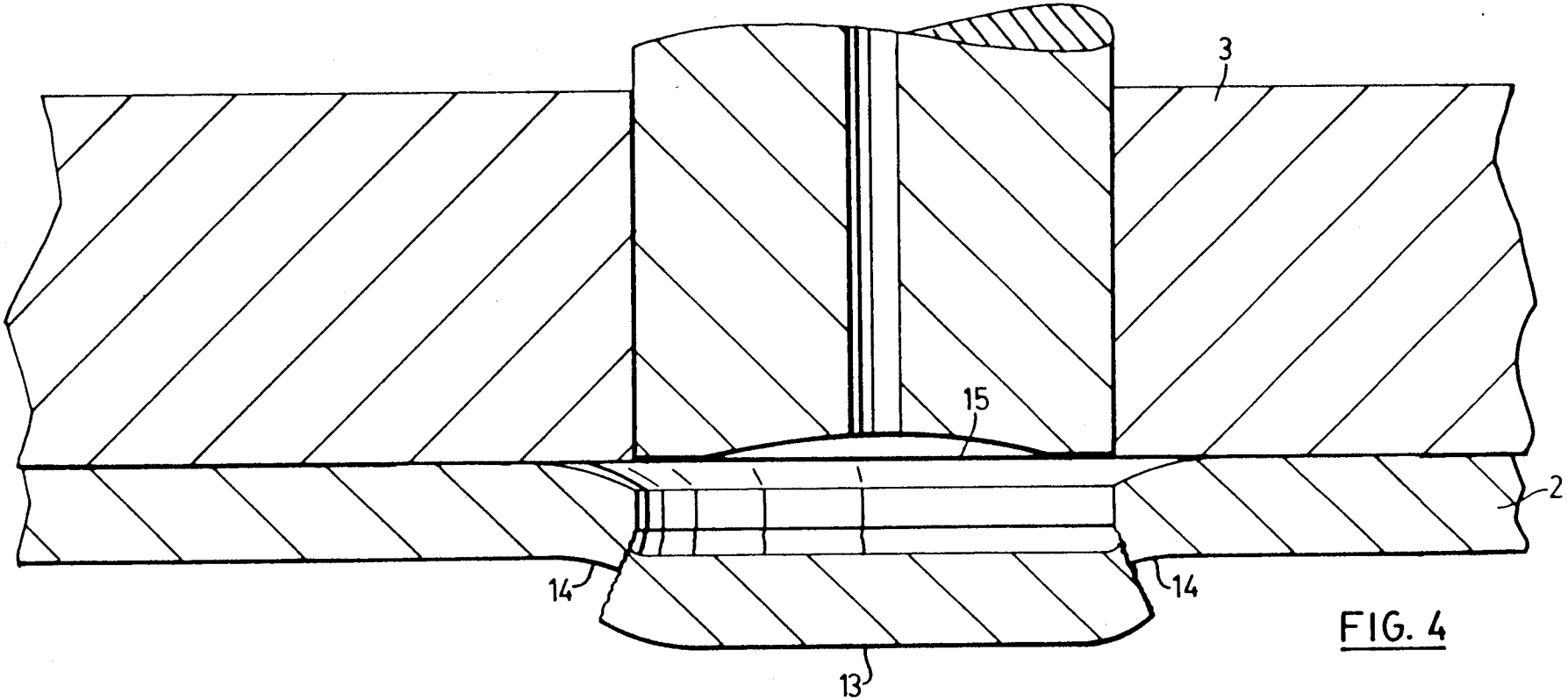
FIG. 4 is a sectional view showing the final retracted position of the punch and the deformed area retracted to a substantially flat state.

Referring to FIGS. 3 and 4, in accordance with the invention is provided a method comprising withdrawing the punch 6 from the hole 15 while maintaining the fluid 5 under pressure, such that the slug 13 engages the material 2 adjacent the perimeter of the hole 15. As the punch 6 is further retracted, the fluid 5 pressure bearing upon the slug 13 and the sheet material 2, forces the slug 13 and the deformed area 14 of the sheet material 2 toward the die block 3 face, retracting the deformed area 14 toward the die block 3 face.

Since the slug 13 is larger than the hole 15, as a result of deformation during punching, depending upon the extent of deformation the slug 13 may be only partially, or substantially fully inserted into the hole 15 as the punch 6 is withdrawn. As the deformed area 14 is retracted toward the die block 3, the hole 15 may nominally decrease in size (for example 0.001 to 0.003 inches). The slug 13 inserted in the hole 15 therefore is clamped within the hole 15 as the deformed area 14 is retracted toward the die block 3. Upon fully retracting the punch 6, as shown in FIG. 4, the fluid 5 pressure is released and the fluid 5 drained away from the rearward face 4.

In the embodiment shown in FIG. 4 the deformed area 14 is retracted such that the deformed area is substantially flat at the completion of the retracting operation. Depending upon the material thickness, tensile strength, liquid pressure and punch face 7 dimensions, the deformed area 14 may be partially retracted toward the die block 3 face such that the deformed area 14 is countersunk away from the die block 3 face. In addition the pressure of the fluid 5 during punching and during retraction may be varied. The pressure may be increased during retraction to provide additional force to flatten the deformed area 14 or may be decreased during retraction to retain a partially retracted deformed area 14 if a countersunk effect is desired.

In order to describe in detail the results attained through the use of the invention, a description of the results of an experimental test will be described. A test was carried out using a 10 mm diameter punch 6 (0.394 in.) having a concave central portion 9, first bore 10 and second bore 11 communicating with a zone of atmospheric pressure 12. Sheet material 2 comprised of SAE1010 steel of thickness 0.065 in., and yield strength 40,000 psi. A fluid pressure of 5,000 psi was used. After the punching operation was completed the sheared slug was measured and found to have the following dimensions: forward face diameter 0.400 in.; rearward face diameter 0.408 in.; slug outer edge thickness 0.036 in. As is generally observed when punching or shearing is carried out, the edges of the hole have two distinct zones, of depth approximately one-half the material thickness: a first sheared zone having a relatively smooth surface adjacent the forward face; and a second fractured zone having a relatively coarse surface adjacent the rearward face. The outer edge of the slug had a coarse fractured surface similar to the second zone.

I claim:

1. A method of punching a hole in sheet material comprising:

positioning a forward surface of said sheet material adjacent a die block face;

exposing a rearward surface of said sheet material, opposite said forward surface, to pressurized fluid;

advancing a punch housed within the die block to engage said forward surface, the punch having a forward face with a perimeter cutting edge, a space between said forward surface and the face of said punch maintained at a pressure less than the pressure of said fluid by venting means comprising a bore communicating between the punch face and a zone of pressure lower than the pressure of the fluid;

further advancing said punch through said sheet material to shear a slug from said material, said slug during and after shearing being continuously held against the face of said punch by the difference in pressure between said fluid and said space adjacent said punch face.

2. A method according to claim 1, wherein as the punch advances to punch the hole, a deformed area of sheet material is formed adjacent the cutting edge of the punch, said deformed area being formed as said sheet material is drawn away from the adjacent die block face, said method further comprising withdrawing the punch from the hole, while maintaining said fluid under pressure, such that the slug engages the material adjacent the perimeter of the hole and the fluid pressure bearing upon the slug and sheet material forces said slug and said deformed area of sheet material toward the die block face, thereby retracting the deformed area toward the die block face.

3. A method according to claim 2 wherein said deformed area is retracted such that the deformed area is substantially flat.

4. A method according to claim 2 wherein said deformed area is partially retracted toward the die block face such that the deformed area is countersunk away from the die block face.

5. A method according to claim 2 wherein the slug is at least partially inserted into the hole as the punch is withdrawn and the slug is clamped within said hole as the deformed area is retracted toward the die block face.

6. A method according to claim 1 wherein said sheet material comprises a wall of a tube.

7. A method according to claim 1 wherein the difference in pressure is in the range of 100 to 10,000 pounds per square inch.

8. A method according to claim 7 wherein said difference in pressure is in the range of 4,000 to 6,000 pounds per square inch.

9. An apparatus for punching a hole in sheet material comprising:

a die block having a die block face which mates with a forward surface of said sheet material;

means to expose a rearward surface of said sheet material, opposite said forward surface, to pressurized fluid;

a punch housed within said die block, said punch having a forward face and a first bore communicating between the punch face and means to maintain pressure less than the pressure of said fluid, thereby continuously holding a slug against the punch face during and after shearing; and means for advancing said punch relative to said die block face to punch a hole in said sheet material as the punch advances through the material and for retracting the punch to disengage the slug from the punch face.

10. An apparatus in accordance with claim 9, wherein the means to maintain pressure comprise a second bore communicating between the first bore and a zone of ambient atmospheric pressure.

11. An apparatus in accordance with claim 9, wherein the punch face comprises a perimeter cutting edge and a concave central portion.

12. An apparatus in accordance with claim 9, wherein the sheet material comprises a wall of a tube.

* * * * *